United States Patent [19]

Center

[11] Patent Number: 4,691,442

[45] Date of Patent: Sep. 8, 1987

[54] SIGHT SYSTEM FOR A FIREARM

[75] Inventor: Warren A. Center, Alton Bay, N.H.

[73] Assignee: K. W. Thompson Tool Company, Inc., Rochester, N.H.

[21] Appl. No.: 847,698

[22] Filed: Apr. 2, 1986

[51] Int. Cl.[4] ..... F41G 1/02; F41G 1/10

[52] U.S. Cl. ..... 33/253; 33/260

[58] Field of Search ..... 33/253, 257, 260

[56] References Cited

U.S. PATENT DOCUMENTS

| | | | |
|---|---|---|---|
| 644,901 | 3/1900 | Douglass | 33/253 |
| 1,027,891 | 5/1912 | Peck et al. | 33/253 |
| 1,365,236 | 1/1921 | Fletcher et al. | 33/253 |
| 1,450,823 | 4/1923 | Spencer | 33/253 |
| 1,586,413 | 5/1926 | Doornbos | 33/253 |
| 2,244,781 | 6/1941 | Johnson, Jr. | 33/253 |
| 3,495,339 | 2/1970 | Elliason | 33/257 |
| 4,208,821 | 6/1980 | Power | 33/260 |

FOREIGN PATENT DOCUMENTS

| | | | |
|---|---|---|---|
| 21332 | 7/1909 | United Kingdom | 33/253 |

*Primary Examiner*—Richard R. Stearns

*Attorney, Agent, or Firm*—Blodgett & Blodgett

[57] ABSTRACT

Gun sight system comprising a front sight fixture which is mounted at the front end. Each fixture comprises a bracket and a carrier which is mounted on the bracket for movement to a plurality of positions relative to the bracket. The front sight carrier has a plurality of projections of different widths transverse to the axis of the barrel which can be selectively brought into active position in alignment with a sight axis which is located above the barrel by moving the carrier relative to its bracket. The rear sight carrier has a plurality of slots, each having a different width transverse to the axis of the barrel which can be selectively brought into active position in alignment with the sight axis by moving the carrier relative to its bracket.

7 Claims, 12 Drawing Figures

FIG. 3
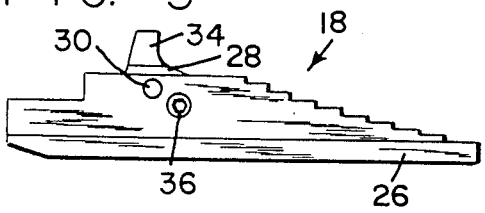
FIG. 4
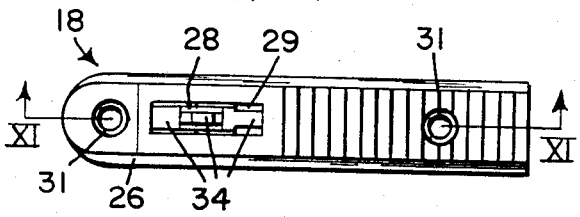
FIG. 7
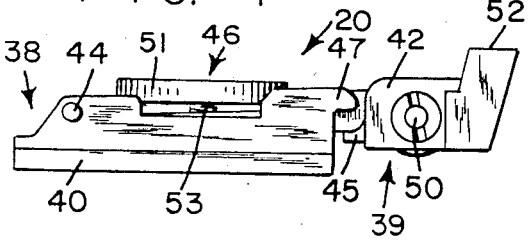
FIG. 8
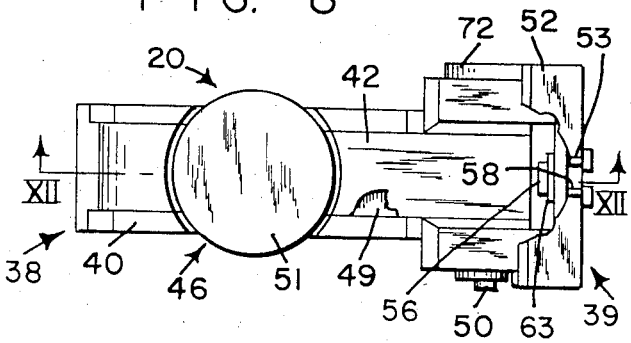
FIG. 5
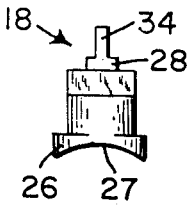
FIG. 9
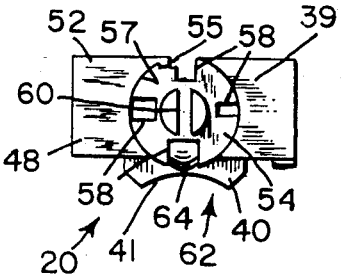
FIG. 10
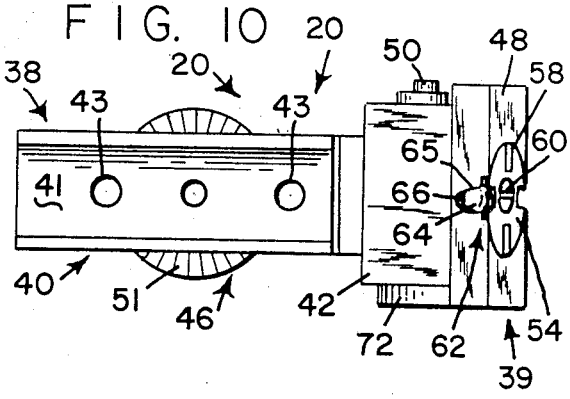
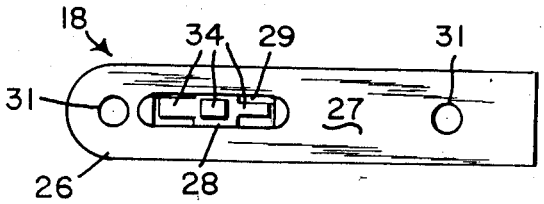
FIG. 6

SIGHT SYSTEM FOR A FIREARM

BACKGROUND OF THE INVENTION

The present invention relates generally to a sight system for a firearm. The sight system for a gun includes a front sight which consists of a vertical projection which extends upwardly from the top of the gun barrel. The sight system also includes a rear sight which consists of a rear bracket at the top of the gun barrel at the rear portion thereof and a vertical flange which extends upwardly from the bracket. The top edge of the vertical flange has a slot which is aligned with the front sight along a sight axis which extends above the gun barrel and which is substantially parallel with the central longitudinal axis of the barrel. The sight axis actually extends at a slight downward angle with respect to the longitudinal axis of the gun barrel from the back of the gun. This angle compensates for the vertical drop of the projectile during its flight after discharge from the gun. The rear sight is usually adjustable for changing the vertical position of the slot relative to the central axis of the gun barrel. The slot is raised for a distant target and lowered for a near target. The rear sight is also adjustable for changing the horizontal position of the slot relative to the central axis of the gun barrel to compensate for windage or other factors which tend to cause the projectile to go to one side or the other from the central axis of the gun barrel. These adjustments allow the shooter to set the sight axis so that when the sight axis is aligned with the target and the gun is fixed in position, the projectiles will consistently strike the target. These adjustments relate to the accuracy of the gun itself. However, shooting involves a great deal more than the accuracy of the gun. The human factor is the greatest variable of all. Even with a ballistically perfect gun, there is a difference in shooting accuracy between one person and another. The art of shooting has many variables. However, the one variable which is important for the purpose of the present invention is the alignment between the front sight and the rear sight. Shooting accuracy depends a great deal on the shooter consistently visually aligning the front sight within the slot of the rear sight. Normally, the top of the front sight is visually aligned with the bottom of the target and the top of the slot of the rear sight. Some shooters prefer to have the front sight substantially visually fill the slot of the rear sight with a slight clearance on each side of the front sight. Other shooters prefer to have a greater clearance on both sides of the front sight. If the shooter has developed a particular shooting style, all aspects of this style must remain the same to maintain shooting accuracy. In order to maintain a consistent shooting style, the gun must be held in the same position relative to all parts of the shooter's anatomy and the front sight must be viewed within the slot of the rear sight in exact manner of the shooter's preference. If the relationship between the front sight and the rear sight is not of the shooters preference, compensation must be made in the way that the gun is held to achieve the proper relationship between the front and rear sights. Unfortunately, when one compensation is made, other compensations have to be made which takes the shooter out of the acquired pattern of consistency which is essential for accuracy. For this reason, serious shooters have their guns specifically set for their own personal shooting style. Generally, the shooter will not be able to shoot as accurately with another gun. There are many factors which make it difficult to achieve a desired orientation between the rear and front sights. The two main factors are the distance between the front and rear sights and the distance between the rear sight and the shooter's eye. The first factor is determined by the length of the gun barrel and the second factor is determined by the shape and dimensions of the rear portion of the gun and the particular manner in which the gun is held by the shooter. Because of these two factors and many other variables, it is highly unlikely that a serious shooter can purchase a gun or a new sight system for a gun which is already owned by the shooter without performing substantial modifications to suit the gun to the shooter's needs. These and other difficulties experienced with the prior art sight systems have been obviated by the present invention.

It is, therefore, a principle object of the invention to provide a universal sight system for a gun which enables the gun to be used by different individuals having different shooting styles.

Another object of this invention is the provision of a universal gun sight system for a gun which eliminates the need for extensive modification of guns and/or sight systems to suit the particular needs of the individual.

A further object of the present invention is the provision of a universal gun sight system which is capable of assuming a plurality of front sight to rear sight ratios to compensate for variables between guns and between individuals.

It is another object of the present invention to provide a universal rear sight which can be used with existing front sights to achieve a plurality of front sight, rear sight ratios.

A still further object of the invention is the provision of a universal front sight which can be used with existing rear sights to achieve a plurality of front sight to rear sight ratios.

It is a further object of the invention to provide a universal gun sight system which is simple in construction and easy to use and capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

The invention consists of a gun sight system comprising a front sight fixture which is mounted to the outer surface of a gun barrel at the forward end of a barrel and a rear sight fixture which is mounted at the rearward portion of the gun barrel. Each fixture includes a bracket which is mounted to the barrel and a carrier which is mounted on the bracket for movement to a plurality of positions. The carrier of the front sight fixture has a plurality of projections, each of which has a different width. The carrier of the rear sight fixture has a plurality of slots each having a different width. For each position of the front sight carrier, a different projection intersects the sight axis of the gun. For each position of the rear sight carrier, a different sight slot intersects the sight axis of the gun. The invention also comprises a front sight as described above which can be used with an existing rear sight and a rear sight as described above which can be used with an existing front sight.

BRIEF DESCRIPTION OF THE DRAWINGS

The character of the invention, however, may be best understood by reference to one of its structural forms, as illustrated by the accompanying drawings, in which:

FIG. 3 is a side elevational view of the front sight of the present invention, FIG. 4 is a plan view of the front sight, FIG. 5 is a front elevational view of the front sight, FIG. 6 is a bottom plan view of the front sight, FIG. 7 is a side elevational view of the rear sight, FIG. 8 is a plan view of the rear sight, FIG. 9 is a rear elevational view of the rear sight, FIG. 10 is a bottom plan view of the rear sight.

DESCRIPTION OF THE PREFERRED EMBODIMENT

Figure 1:
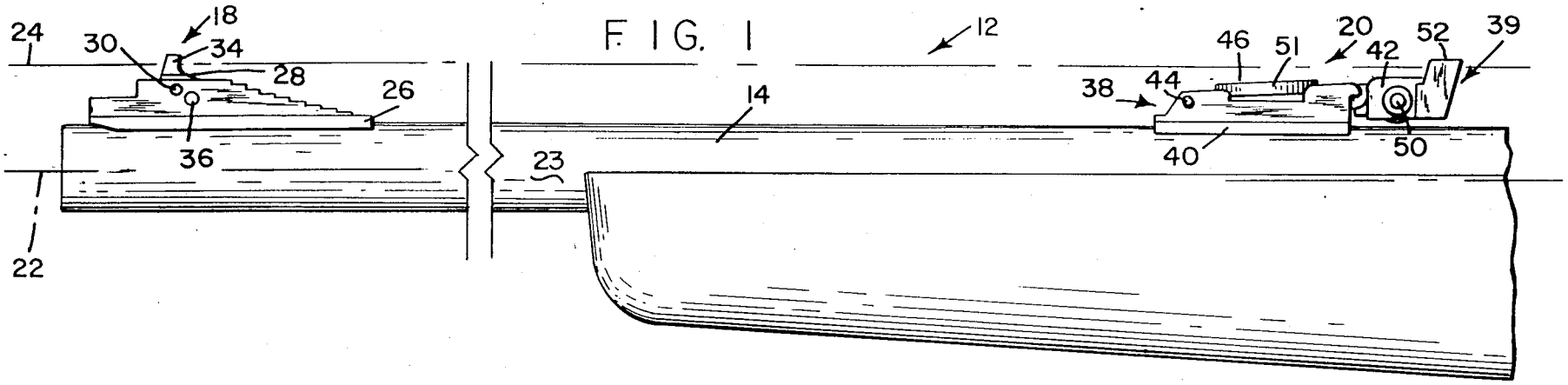
FIG. 1 is a side elevational view of a gun sight system embodying the principles of the present invention.
Figure 2:
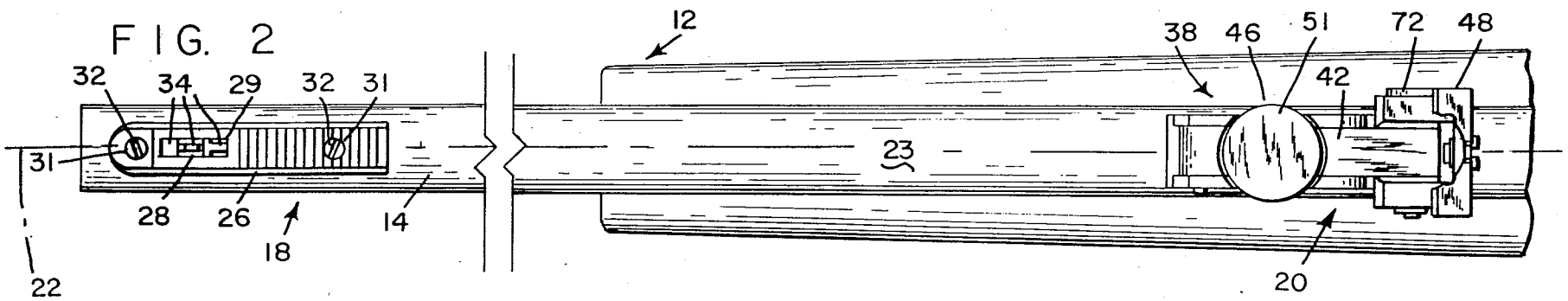
FIG. 2 is a plan view of the gun sight system.

Referring first to FIGS. 1 and 2, a gun sight system embodying the general principles of the present invention is generally indicated by the reference numeral 12 and includes a gun barrel 14. The gun sight system 12 comprises a front sight fixture, generally indicated by the reference numeral 18, and a rear sight fixture which is generally indicated by the reference 20. The barrel 14 has a central longitudinal axis 22 and a cylindrical outer surface 23. The front sight fixture 18 is mounted on the surface 23 at the front end of the barrel 14 and the rear sight fixture 20 is mounted on the surface 23 at the rear of the gun barrel 14. The front and rear sight fixtures 18 and 20, respectively, are mounted at the top of the gun barrel 14 and are horizontally aligned along a sight axis 24 which is substantially parallel with the central longitudinal axis 22 of the gun barrel. The sight axis 24 extends at a slight downward angle relative to the axis 22 from the rear of the barrel to the front of the barrel. This is due in part to the fact that the sight axis 24 is located above the central axis 22 and, in part, to the laws of ballistics. The rear sight is vertically adjustable so that the angle of the sight axis can be changed relative to the barrel axis. The further the target, the greater the vertical drop of the projectile from the gun barrel to the target. Therefore the angle of the sight axis 24 relative to the central axis 22 of the gun barrel is increased for a distant target and decreased for a near target.

Figure 11:
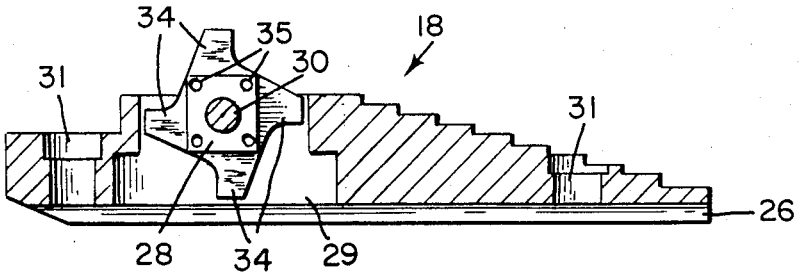
FIG. 11 is a vertical cross-sectional view taken along the line XI—XI of FIG. 4.

Referring also to FIGS. 3–6, the front sight fixture 18 comprises a front bracket 26 which has a curved bottom surface 27 which conforms to the curvature of the outer surface 23 of gun barrel 14 and a pair of vertical holes 31 which enable the bracket to be attached to the gun barrel by fastening means, such as screws 32. The front sight fixture also comprises a front sight carrier 28 which is located within a vertical slot 29 of the bracket 26 and is rotatably mounted to the bracket 26 by means of a pivot pin 30. The front sight carrier 28 has a plurality of projections 34 which radiate from the pin 30. In the preferred embodiment, there are four projections 34 and each projection has a different width transverse to the sight axis 24. The front sight carrier 28 can be rotated about the pivot pin 30 to a plurality of active positions relative to the front bracket 26. For each position of the front sight carrier 28, a different one of the projections 34 is brought into alignment with the sight axis 24. The projections 34 are spaced 90° apart about the carrier 28, see also FIG. 11, so that when one of the projections 34 is in alignment with the sight axis 24 as shown in FIG. 1, the remaining projections 34 are located within the vertical slot 29. The front sight carrier 28 can be selectively moved to any one of its active positions to bring a selected one of the projections 34 into alignment with the sight axis 24. The front sight carrier 28 can then be locked into any one of the selective positions by means of a plurality of locating holes 35 in the carrier 28 and a set screw 36. The set screw 36 is threaded into the front bracket 26 and engages one of the locating holes 35 to prevent rotation of the front sight carrier 28 relative to the bracket 26.

Figure 12:
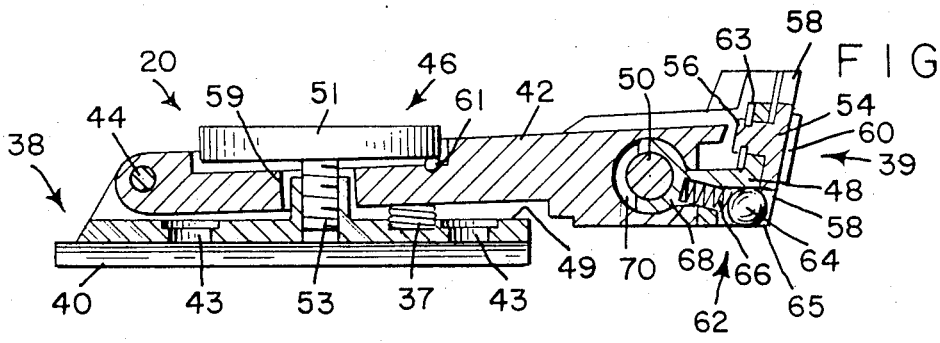
FIG. 12 is a vertical cross-sectional view taken along the line XII—XII of FIG. 8.

Referring again to FIGS. 1, 2, 7–10 and 12, the rear sight fixture 20 comprises a rear bracket which is generally indicated by the reference numeral 38 and a rear sight carrier which is generally indicated by the reference numeral 39. The rear sight carrier 39 is rotatably mounted on the bracket 38 for a selective movement to a plurality of active positions. The rear bracket 38 comprises a horizontal base portion 40 which has a curved bottom surface 41 which conforms to the outer surface 23 of the barrel 14. A pair of holes 43 extend through the horizontal base portion 40 to enable the base portion to be attached to the barrel 14 by means of screws, not shown. A horizontal lever 42 is pivotally attached to the base portion 40 by means of a pivot pin 44. A spring 37, see FIG. 12, urges the lever 42 to its highest position relative to the base portion 40. Referring particularly to FIG. 7, the highest position of the lever 42 is determined by a forwardly extending horizontal shoulder 45 on the lever 42 and a rearwardly extending horizontal shoulder 47 on the base portion 40. The lowest position of the lever 42 is determined by an upper surface 49 of the base portion 40 which is in vertical alignment with the lever 42, see FIG. 12. The lever 42 can be selectively positioned at any point between the highest and lowest positions of the lever by an adjusting screw 46. The adjusting screw 46 has an enlarged head portion 51 and a shank portion 53 which extends freely through an aperture 59 in the lever 42 and is threaded into the base portion 40. The enlarged head portion 51 enables the screw 46 to be turned by the shooter's fingers. The bottom surface of the head 51 is provided with a plurality of radial locating grooves, not shown. A small ball 61 is embedded in the upper surface of the lever 42 beneath the head 51. The ball 61 is urged into engagement with the locating grooves by the spring 37 to hold the head 51 in any set position. However, the shooter can rotate the head 51 without too much difficulty to change the angle of the lever 42 relative to the base 40. The locating grooves provide small incremental adjustments for adjusting the lever 42 to position the rear sight carrier 39 to any desired vertical position for changing the angle of the sight axis 24.

The rear sight carrier 39 consists of a circular disk 54 which has an integral shaft 56. The shaft 56 is mounted in the vertical bracket 48 for rotation about a horizontal axis and held in place by a retaining washer 63, see FIG. 12. The disk 54 is located within a circular recess 57 in the rear surface of the vertical bracket 48, see FIG. 9. The vertical bracket 48 is slidably mounted on the rear end of the lever 42 for horizontal movement in a direction which is transverse to the sight axis 24. The vertical bracket 48 includes a forwardly extending projection 68 which is slidably mounted in a groove 70 in the lever 42.

An adjusting screw 50 extends freely through the end of the lever 42 and is threadedly engaged with forwardly extending projection 68 of the bracket 48. The screw 50 has a large head 72 which enables the screw to be rotated by the shooter. As the adjusting screw 50 is rotated, the bracket 48 is moved horizontally and transversely of the lever 42. The lever 42 is provided with detent means, not shown, for yieldably engaging the head 72 of the adjusting screw 50 to provide small incremental adjustments of the bracket 48 relative to the lever 42. The circular disk 54 is provided with a plurality of sight slots 58. The sight slots 58 radiate from the center of the shaft 56 and are located 90° apart. Each sight slot 58 has a different width transverse to the sight axis 24. The bracket 48 has a top edge surface 52 and a vertical sight opening 55 which extends downwardly from the surface 52.

The sight slots 58 can be selectively brought into alignment with the sight opening 55 by rotating the disk 54 to any one of its four active positions. The shaft 56 is provided with an outer groove 60 which enables the circular disk 54 to be rotated by means of a screwdriver or coin. The disk 54 is maintained in each one of its active positions by detent means, generally indicated by the reference numeral 62. The detent means 62 comprises a ball 64 which is mounted in a cavity 65 in the outer surface of the bracket 48 and is biased against the front surface of the disk 54 by means of a spring 66. The ball 64 is diametrically opposed to the sight opening 55 so that when a particular sight slot 58 is brought into alignment with the sight opening 55, the ball 64 engages the sight slot 58 which is diametrically opposed to the sight slot which is brought into alignment with the sight opening. The sight opening 55 has a greater width than any of the sight slots 58 so that when any one of the sight slots 58 is brought into alignment with the sight opening 55, it effectively restricts the sight opening. The sight opening 55 is horizontally aligned with the upper-most or active projection 34 of the front sight carrier 28 so that the sight axis 24 extends through the active projection 34 and the active sight opening 55. The effective width of the sight opening can be varied by selectively rotating the circular disk 54 to any one of its active positions. The vertical angle of the sight axis 24 relative to the axis 22 of the gun barrel can be changed by the adjusting screw 46 which effectively raises or lowers the position of the sight opening. The horizontal angle of the sight axis 24, relative to the axis 22 of the gun barrel, can also be changed by moving the sight opening to the left or to the right of the gun barrel by the adjusting screw 50.

It can be seen from the above description that the rear sight 20 is truly a universal instrument which provides all of the adjustments which are normally required for sighting of a firearm. The rear sight 20 can be used in conjunction with any conventional front sight as well as the front sight 18 of the present invention. The front sight 18 can also be used with any conventional rear sight and represents a substantial improvement over conventional front sights because of its capacity to selectively present a front sight element of four different widths. However, when the front and rear sights of the present invention are used together, a greater number of front-to-rear sight ratios can be obtained than the combined ratios of both sights used alone. For example, in the present case, the front sight fixture and the rear sight fixture of the present invention each has four different size adjustments. However, by combining the front and rear sight fixtures, 16 different front to rear sight ratios can be obtained. A firearm which is equipped with the sight system of the present invention can be utilized by a plurality of individuals. An individual can adapt the sight system of the present invention to his or her particular needs by adjusting one or both sights to obtain the optimum front-to-rear sight ratio for that individual. In addition, the present invention provides a convenient means for a less experienced shooter to find his or her optimum front-to-rear sight ratio.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Gun sight system comprising:

(a) a gun barrel having a rearward end, a forward end, an outer surface and a central longitudinal axis which correlates with a sight axis which is located above said outer surface and which is substantially parallel with said central longitudinal axis, (b) a front sight fixture having a front bracket which is mounted to the outer surface of the barrel at the forward end of the barrel, and a front sight carrier which has a plurality of projections, each of said projections having a different width than the other projections within a plane which is transverse to said sight axis, said front sight carrier being mounted on said front bracket for selective movement to a plurality of positions relative to said front bracket so that for each position of said front sight carrier, a different one of said projections intersects said sight axis and constitutes the front sight of the gun, (c) a rear sight fixture having a rear bracket which is mounted to the outer surface of the barrel at the rearward end of the barrel, and a rear sight carrier which has a plurality of sight slots, each of said slots having a different width than the other slots within a plane which is transverse to said sight axis, said rear sight carrier being mounted on said rear bracket for selective movement to a plurality of positions relative to said rear bracket so that for each position of said rear sight carrier, a different one of said sight slots intersects said sight axis and constitutes the rear sight of the gun, (d) means for releasably locking said front sight carrier to said front bracket in each of its positions, and (e) a biased detent which is mounted in the rear bracket for engaging one of the sight slots which is not in alignment with the sight axis for yieldingly locking the rear sight carrier in each of its positions.

2. Gun sight system as recited in claim 1, wherein the locking means for said front sight fixture comprises a set screw which is threaded into said front bracket for engaging said front sight carrier to prevent relative movement between the front sight carrier and the front bracket.

3. Gun sight system as recited in claim 1, wherein said rear sight carrier is mounted on said rear bracket for rotation about a horizontal axis which is parallel with said sight axis, and wherein said detent is a ball and a spring for urging the ball against the rear sight carrier so that the ball seats into one of said sight slots for each position of the rear sight carrier for preventing said rear sight carrier from rotating about said horizontal axis for any torque which is applied to said rear sight carrier below a predetermined value.

4. Gun sight system as recited in claim 3, wherein said rear sight carrier is provided with an outer groove which intersects said horizontal axis for receiving the blade of a screwdriver or coin for the purpose of applying sufficient torque to the rear sight carrier to rotate the rear sight carrier about said horizontal axis.

5. Rear sight fixture for a gun barrel having a rearward end, a forward end, and outer surface and a central longitudinal axis which correlates with a sight axis which is located above said barrel and which is substantially parallel with said central longitudinal axis, said rear sight fixture comprising:

(a) a rear bracket which is adapted to lie along said outer surface at the rearward end of the gun barrel beneath said sight axis, (b) fastening means for removably fastening the rear bracket to the barrel, (c) a rear sight carrier which has a plurality of sight slots, each of said sight slots having a different width than the other slots within a plane which is tranverse to said sight axis, said rear sight carrier being mounted on said rear bracket for selective movement to a plurality of positions relative to said rear bracket so that for each position of said rear sight carrier, a different one of said sight slots intersects said sight axis and constitutes the rear sight of the gun, (d) a biased detent which is mounted in the rear bracket for engaging one of the sight slots which is not in alignment with the sight axis for yieldingly locking the rear sight carrier in each of its positions.

6. Rear sight fixture as recited in claim 5, wherein said rear sight carrier is mounted on said rear bracket for rotation about a horizontal axis which is substantially parallel with said sight axis and wherein said detent is a ball and a spring for urging the ball against the rear sight carrier so that the ball seats into one of said sight slots for each position of the rear sight carrier for preventing said rear sight carrier from rotating about said horizontal axis for any torque which is applied to said rear sight carrier below a predetermined value.

7. Rear sight fixture as recited in claim 6, wherein said rear sight carrier is provided with a outer groove which intersects said horizontal axis for receiving the blade of a screwdriver for the purpose of applying sufficient torque to the rear sight carrier to rotate the rear sight carrier about said horizontal axis.

* * * * *